US010051401B2

(12) United States Patent
Lehtiniemi et al.

(10) Patent No.: US 10,051,401 B2
(45) Date of Patent: Aug. 14, 2018

(54) SPATIAL AUDIO PROCESSING

(71) Applicant: Nokia Technologies Oy, Espoo (FI)

(72) Inventors: Arto Juhani Lehtiniemi, Lempäälä (FI); Antti Johannes Eronen, Tampere (FI); Jussi Artturi Leppänen, Tampere (FI); Juha Henrik Arrasvuori, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/634,069

(22) Filed: Jun. 27, 2017

(65) Prior Publication Data

US 2018/0007490 A1 Jan. 4, 2018

(30) Foreign Application Priority Data

Jun. 30, 2016 (EP) ..... 16177335

(51) Int. Cl.
*H04S 7/00* (2006.01)
*H04S 3/00* (2006.01)
*G10L 21/0208* (2013.01)

(52) U.S. Cl.
CPC ..... *H04S 7/303* (2013.01); *G10L 21/0208* (2013.01); *H04S 3/008* (2013.01);
(Continued)

(58) Field of Classification Search
CPC ..... H04S 7/303; G10L 2021/0208
See application file for complete search history.

(56) References Cited

U.S. PATENT DOCUMENTS 5,696,831 A 12/1997 Inanaga et al.
2008/0025538 A1* 1/2008 Zad-Issa ..... H04R 25/43 381/315

(Continued)

FOREIGN PATENT DOCUMENTS

EP EP 2675187 A1 * 12/2013 ..... H04R 3/12
WO WO 2013144417 A1 * 10/2013 ..... G01S 3/8083
WO 2015/177224 A1 11/2015

OTHER PUBLICATIONS

"Digital Mixing Console", Wikipedia, Retrieved on Jun. 30, 2017, Webpage available at : https://en.wikipedia.org/wiki/Digital_mixing_console.

(Continued)

*Primary Examiner* — Mohammad Islam
(74) *Attorney, Agent, or Firm* — Alston & Bird LLP

(57) ABSTRACT

An apparatus comprising at least one processor and at least one memory, the memory comprising machine-readable instructions, that when executed cause the apparatus to: store in a non-volatile memory multiple sets of predetermined spatial audio processing parameters for differently moving sound sources; provide in a man machine interface an option for a user to select one of the stored multiple sets of predetermined spatial audio processing parameters for differently moving sound sources; and in response to the user selecting one of the stored multiple sets of predetermined spatial audio processing parameters for differently moving sound sources, the apparatus is further caused to use the selected one of the stored multiple sets of predetermined spatial audio processing parameters to spatially process audio from one or more sound sources.

20 Claims, 2 Drawing Sheets

(52) U.S. Cl.
CPC ..... *H04S 2400/01* (2013.01); *H04S 2400/11* (2013.01); *H04S 2420/03* (2013.01)

(56) References Cited

U.S. PATENT DOCUMENTS

| | | | | |
|---|---|---|---|---|
| 2011/0235810 | A1 | 9/2011 | Neusinger et al. | |
| 2012/0207309 | A1 | 8/2012 | Eppolito | |
| 2013/0022206 | A1* | 1/2013 | Thiergart | G10L 19/008 381/17 |
| 2013/0148720 | A1* | 6/2013 | Rabii | G06F 3/1454 375/240.12 |
| 2014/0226842 | A1* | 8/2014 | Shenoy | H04N 7/147 381/303 |
| 2014/0341547 | A1 | 11/2014 | Shenoy et al. | |
| 2014/0348342 | A1 | 11/2014 | Laaksonen et al. | |
| 2015/0382106 | A1* | 12/2015 | Kraft | H04R 1/1083 381/119 |
| 2016/0299738 | A1* | 10/2016 | Makinen | H04S 3/002 |
| 2017/0147281 | A1* | 5/2017 | Klimanis | G06F 3/165 |
| 2017/0242655 | A1* | 8/2017 | Jarvis | H04S 7/301 |
| 2017/0269901 | A1* | 9/2017 | Klimanis | G06F 3/165 |

OTHER PUBLICATIONS

"Mixing and Spatial Techniques for 5.1 Surround", Lynda.Com, Retrieved on Jun. 30, 2017, Webpage available at : https://www.lynda.com/Pro-Tools-tutorials/Mixing-spatial-techniques-51-surround/77862/85462-4.html.

Shah et al., "Metrics for Measuring Ideation Effectiveness", Design Studies, vol. 24, No. 2, Mar. 2003, pp. 111-134.

Smith, "Idea-Generation Techniques: A Formulary of Active Ingredients", Wiley, vol. 32, No. 2, 1998, pp. 107-133.

Smith, "Towards a logic of innovation", The International Handbook on Innovation, 2003. p. 347-365.

Partial European Search Report received for corresponding European Patent Application No. 16177335.3, dated Dec. 23, 2016, 7 pages.

Extended European Search Report received for corresponding European Patent Application No. 16177335.3, dated Mar. 13, 2017, 14 pages.

* cited by examiner

SPATIAL AUDIO PROCESSING

TECHNOLOGICAL FIELD

Embodiments of the present invention relate to spatial audio processing. In particular, they relate to spatial audio processing of audio from moving sound sources.

BACKGROUND

A sound object as recorded is a recorded sound object. A sound object as rendered is a rendered sound object.

The recorded sound objects in the recorded sound scene have positions (as recorded) within the recorded sound scene. The rendered sound objects in the rendered sound scene have positions (as rendered) within the rendered sound scene.

Spatial audio renders a recorded sound object (sound source) as a rendered sound object (sound source) at a controlled position within the rendered sound scene.

If a rendered sound scene is to accurately reproduce a recorded sound scene then the positions (as rendered) need to be the same as the positions (as recorded).

It is possible to use a source microphone which moves with a sound source to create a recorded sound object (sound source). One example of a source microphone is a Lavalier microphone. Another example of a source microphone is a boom microphone.

The position of the sound source (microphone) in the recorded sound scene can be tracked. The position (as recorded) of the recorded sound source is therefore known and can be re-used as the position (as rendered) of the rendered sound source. It is therefore important for the position (as rendered) to track the position (as recorded) as the position (as recorded) changes.

However, any measurements of position are subject to noise which introduces (positional) noise to the rendered sound scene.

It would be desirable to reduce or remove such noise.

BRIEF SUMMARY

According to various, but not necessarily all, embodiments of the invention there is provided a method comprising: storing in a non-volatile memory multiple sets of predetermined spatial audio processing parameters for differently moving sound sources; providing in a man machine interface an option for a user to select one of the stored multiple sets of predetermined spatial audio processing parameters for differently moving sound sources; and in response to the user selecting one of the stored multiple sets of predetermined spatial audio processing parameters for differently moving sound sources, using the selected one of the stored multiple sets of predetermined spatial audio processing parameters to spatially process audio from one or more sound sources.

According to various, but not necessarily all, embodiments of the invention there is provided a method comprising: determining an actual or expected change in movement for one or more sound sources rendered as spatial audio; in dependence upon determining an actual or expected change in movement for one or more sound sources rendered as spatial audio, determining that current filter parameters for the one or more sound sources are to be changed; in dependence upon determining that current filter parameters for the one or more sound sources are to be changed, enabling adaptation of the current filter parameters for the one or more sound sources to render the one or more sound sources as spatial audio, compensated for the determined actual or expected change in movement.

According to various, but not necessarily all, embodiments of the invention there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1:
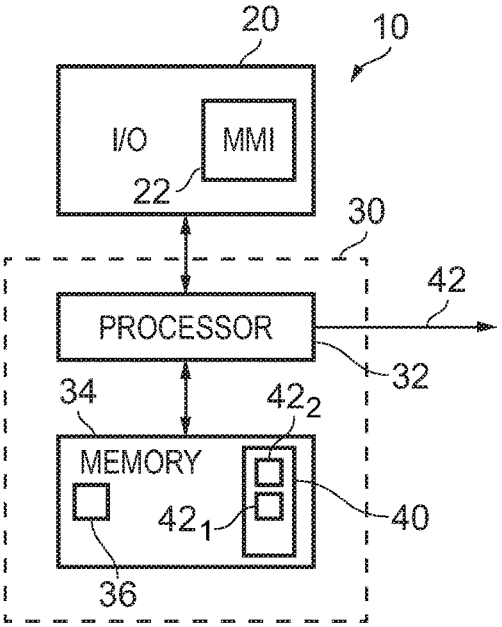
FIG. 1 illustrates an example of an apparatus comprising a controller for at least controlling spatial audio processing via a man machine interface.
Figure 2:
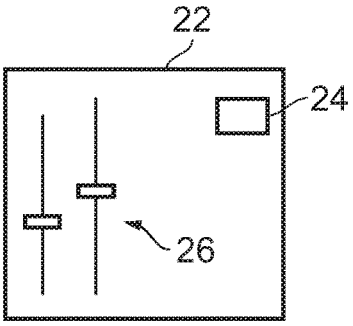
FIG. 2 illustrates an example of a man machine interface for controlling spatial audio processing.

FIG. 1 illustrates an example of an apparatus 10 comprising a controller 30 for at least controlling spatial audio processing via a man machine interface 22. The controller 30 is configured to control input/output circuitry 20 to provide a man machine user interface 22 to a user of the apparatus 10. An example of the MMI 22 is illustrated in FIG. 2.

Implementation of the controller 30 may be as controller circuitry. The controller 30 may be implemented in hardware alone, have certain aspects in software including firmware alone or can be a combination of hardware and software (including firmware).

As illustrated in FIG. 1 the controller 30 may be implemented using instructions that enable hardware functionality, for example, by using executable instructions of a computer program 36 in a general-purpose or special-purpose processor 32 that may be stored on a computer readable storage medium (disk, memory etc.) to be executed by such a processor 32.

The processor 32 is configured to read from and write to the memory 34. The processor 32 may also comprise an output interface via which data and/or commands are output by the processor 32 and an input interface via which data and/or commands are input to the processor 32.

The memory 34 stores a computer program 36 comprising computer program instructions (computer program code) that controls the operation of the apparatus 10 when loaded into the processor 32. The computer program instructions, of the computer program 36, provide the logic and routines that enables the apparatus to perform the methods illustrated in FIGS. 1-8. The processor 32 by reading the memory 34 is able to load and execute the computer program 36.

In this example, the memory 34 is a non-volatile memory storing, in a database 40, multiple sets 42 of predetermined spatial audio processing parameters P for differently moving sound sources 80.

As illustrated in the example in FIG. 2, the man machine interface 22 presents a user-selectable option 24 that enables the user to select one of the stored sets 42 of predetermined spatial audio processing parameters P for differently moving sound sources 80.

The controller 30, in response to the user selecting one of the stored sets 42 of predetermined spatial audio processing parameters P for differently moving sound sources 80, uses the selected one of the stored multiple sets 42 of predetermined spatial audio processing parameters P to spatially process audio from one or more sound sources 80.

The controller 30 may itself perform the spatial audio processing or it may instruct another processor to perform the spatial audio processing.

In some examples, selection of an option 24 by the user may cause the selected spatial audio processing parameters P to be used to spatially process audio from one sound source or from a group of sound sources. The option may visually indicate that sound source of that group of sound sources.

In other examples, a different user selectable option 24 may be provided for each different sound source or each different group of sound sources. Selection of an option causes the selected spatial audio processing parameters P to be used to spatially process audio from the one sound source or from the group of sound sources associated with the selected option 24.

The option 24 may visually indicate that sound source of that group of sound sources associated with that option 24.

In other examples, the user may be able to select which sound source or which group of sound sources, the selected spatial audio processing parameters P are used to spatially process audio from. The option 24 may then visually indicate the selected sound source or selected group of sound sources associated with that option.

In this particular example, the non-volatile memory 34 stores at least a first set $\mathbf{42}_1$ of predetermined spatial audio processing parameters P for slowly moving sound sources 80; and a second set $\mathbf{42}_2$ of predetermined spatial audio processing parameters P for quickly moving sound sources 80.

An option 24 presented in the user interface may present two or more independently user selectable options, for example, a first one for the first set $\mathbf{42}_1$ of predetermined spatial audio processing parameters P for slowly moving sound sources 80 and a second one for the second set $\mathbf{42}_2$ of predetermined spatial audio processing parameters P for fast moving sound sources 80. The first option may visually indicate to a user that selection of this option by a user should be made for slowly moving sound sources. The second option may visually indicate to a user that selection of this option by a user should be made for fast moving sound sources.

Instead of presenting both the first option and the second option prompting manual selection, the system may perform semi-automatic selection and present only the first option if the associated sound source or group of sound sources is slow moving and present only the second option if the if the associated sound source or group of sound sources is fast moving.

The man machine interface 22 may have user input controls 26 configured to adapt one or more of the spatial audio processing parameters P of the selected one of the stored multiple sets 42 of predetermined spatial audio processing parameters P. In some but not necessarily all examples, the adaptation changes the spatial audio processing parameters P in use for spatially processing audio. However, the stored sets 42 of predetermined spatial audio processing parameters P for differently moving sound sources 80 are not varied, they are read-only.

The above mentioned group or groups of sound sources may be a sub-set or sub-sets of active sound sources. The sub-sets may be user selected or automatically selected.

Figure 3:
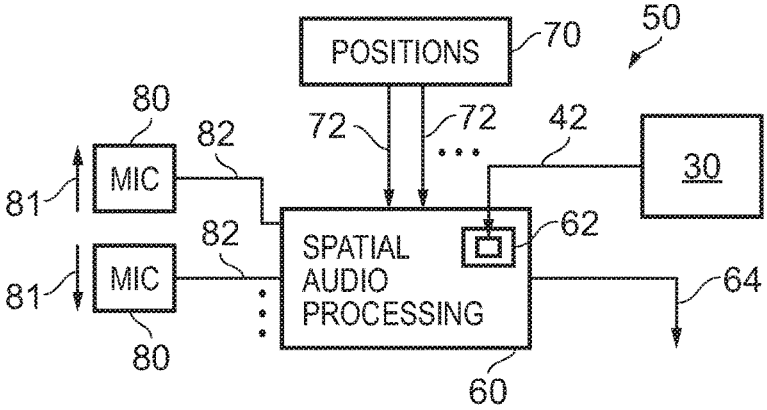
FIG. 3 illustrates an example of a system for spatial audio processing audio from multiple sound sources that may move.

FIG. 3 illustrates an example of a system for spatial audio processing audio from multiple sound sources 80 that may move 81.

Each of the microphones 80 represents a sound source (a recorded sound object). At least some of the microphones 80 are capable of independent movement 81. A movable microphone may, for example, be a Lavalier microphone or a boom microphone.

The processor 60 is configured to process the audio 82 recorded by the movable microphones 80 to produce spatial audio 64 which when rendered produces one or more rendered sound objects at specific controlled positions within a rendered sound scene.

The recorded sound objects in the recorded sound scene have positions 72 within the recorded sound scene. The position module 70 determines the positions 72 and provides them to the processor 60.

If a rendered sound scene is to accurately reproduce a recorded sound scene then the positions (as rendered) of sound sources need to be the same as the positions (as recorded).

The positions 72 are subject to noise which introduces (positional) noise to the rendered sound scene. It would be desirable to reduce or remove such noise.

The controller 30 provides a set 42 of predetermined spatial audio processing parameters P to the processor 60.

The set 42 of predetermined spatial audio processing parameters P are used by the processor 60 to control production of the spatial audio 64. In particular, to control rendering of one or more sound sources in the rendered sound scene.

In some but not necessarily all examples, at least some of the stored sets 42 of predetermined spatial audio processing parameters P for differently moving sound sources 80, when used for the same sound source (or group of sound sources), cause one or more of the following relative differences during spatial audio processing: different location-based processing such as, for example, different orientation or distance; different sound intensity; different frequency spectrum; different reverberation, different sound source size.

The first set $\mathbf{42}_1$ of predetermined spatial audio processing parameters P may be used to control spatial audio processing by processor 60 for a slowly moving sound source 80 or for a group of slowly moving sound sources 80. The resultant spatial audio 64 is compensated for the movement or change in movement of the slowly moving sound source(s) 80.

The second set $\mathbf{42}_2$ of predetermined spatial audio processing parameters P may be used to control spatial audio processing by processor 60 for a fast moving sound source 80 or for a group of fast moving sound sources 80. The resultant spatial audio 64 is compensated for the movement or change in movement of the fast moving sound source(s) 80.

Using a particular set $42_n$ of predetermined spatial audio processing parameters P to control spatial audio processing by processor 60 for multiple sound sources may therefore cause the same relative variation of audio processing parameters for those multiple sound sources 80.

It will be appreciated that different sets $42_n$ of predetermined spatial audio processing parameters P may be used in different combinations for different sound sources 80 having different movements.

It will be appreciated that a set 42 of predetermined spatial audio processing parameters P used for a particular sound source 80 may change (or an option 24 may be provided to change the set 42) when the movement of that sound source changes.

Figure 4:
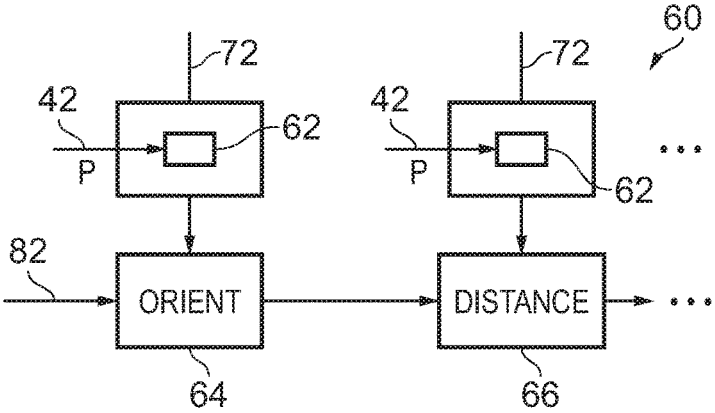
FIG. 4 illustrates an example of a processor for performing spatial audio processing.

In the example illustrated in FIG. 4, the set 42 of predetermined spatial audio processing parameters P are used by the processor 60 to control at least a characteristic of a filter 62. The set 42 of predetermined spatial audio processing parameters P comprises a filter parameter p for the filter 62. The filter 62 controls a position at which one or more sound sources are rendered in the rendered sound scene.

The filter 62 may, for example, be a noise reduction filter used to more accurately position a rendered sound source in the rendered sound scene by removing or reducing noise in the position 72 of the sound source.

For example in some but not necessarily all examples, a first set $42_1$ of predetermined spatial audio processing parameters P for slowly moving sound sources 80 has a first filter parameter $p_1$ for the noise reduction filter 62 suitable for filtering slowly varying positions 72 and a second set $42_2$ of predetermined spatial audio processing parameters P for fast moving sound sources 80 has a second filter parameter $p_2$ for the noise reduction filter 62 suitable for filtering quickly varying positions 72. The first filter parameter and the second filter parameter are different.

The first filter parameter $p_1$ and second filter parameter $p_2$ may define different durations of a filter window used for time averaging. The filter parameter p depends upon the actual or expected speed (rate of change of position 72) of the sound source(s) affected by the filter parameter p. The first filter parameter is longer than the second filter parameter.

Each of the first filter parameter $p_1$ and the second filter parameter $p_2$ may define a variance parameter in a Kalman filter, where the second filter parameter $p_2$ allows for greater change in position 72 than the first filter parameter $p_1$. In some examples, a random walk model may be used with the Kalman filter.

It should be noted that if an incorrect filter parameter is applied then noise or lag increases and that if a correct filter parameter is applied then noise and lag is reduced. The storage and use of multiple sets 42 of predetermined spatial audio processing parameters P for differently moving sound sources 80 in the non-volatile memory 34, makes it much easier for a user of the man machine interface 22 to use correct filter parameters.

In the example of FIG. 4, the processor 60 performs spatial audio processing by controlling an orientation of a rendered sound source using orientation module 64 to process the audio signals 82 from the sound source 80 and rotate the sound source within the rendered sound scene using a transfer function. The extent of rotation is controlled by a bearing of the position 72 after it has been filtered by the filter 62 using a provided filter parameter 42.

The processor 60 performs spatial audio processing by controlling a distance of a rendered sound source using distance module 66 to process the audio signals 82 from the sound source 80. The distance module may simulate a direct audio path and an indirect audio path. Controlling the relative and absolute gain between the direct and indirect paths can be used to control the perception of distance of a sound source. The distance control is based upon a distance to the position 72 after it has been filtered by the filter 62 using a provided filter parameter 42.

The remaining description will refer to filter parameters p as an example of a set 42 of spatial audio processing parameters P.

Figure 5:
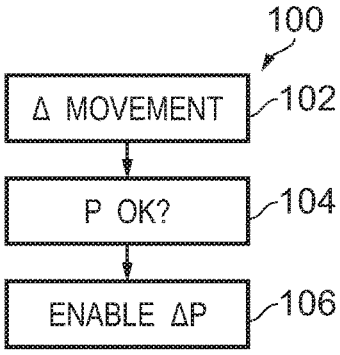
FIG. 5 illustrates an example of a method for enabling adaptation of the current filter parameter p for the one or more sound sources.

FIG. 5 illustrates an example of a method 100 for enabling adaptation of the current filter parameter p for the one or more sound sources 80.

The method at block 102 comprises determining an actual or expected change in movement for one or more sound sources 80 rendered as spatial audio.

The method at block 104 comprises, in dependence upon determining an actual or expected change in movement for one or more sound sources 80 rendered as spatial audio, determining that current filter parameter p for the one or more sound sources 80 is to be changed.

The method at block 106 comprises, in dependence upon determining that a current filter parameter p for the one or more sound sources 80 is to be changed, enabling adaptation of the current filter parameter p for the one or more sound sources 80 to render the one or more sound sources 80 as spatial audio, compensated for the determined actual or expected change in movement.

The actual movement of a sound source may be determined from the position 72 of the sound source. The position 72 of the sound source may be determined by using a positioning system to locate and position the sound source 80 as it moves. Such a positioning system may use one or more of: one or more accelerometers at the microphone 80 or that move with the microphone 80 and then using dead reckoning for positioning, a trilateration or triangulation system based on radio communication between a transmitter/receiver at the microphone 80 or that moves with the microphone, an alternative positioning system such as one that relies on computer vision processing and/or depth mapping.

An expected movement of a sound source may be determined based upon predictive analysis based on patterns of past movement of the sound source.

An expected movement of a sound source may be determined based upon knowledge of future activities or likely future activities of the sound source. This may for example include knowledge of a future increase or decrease in music tempo where the sound source is attached to someone whose movement typically depends upon the tempo of the music.

Figure 6:
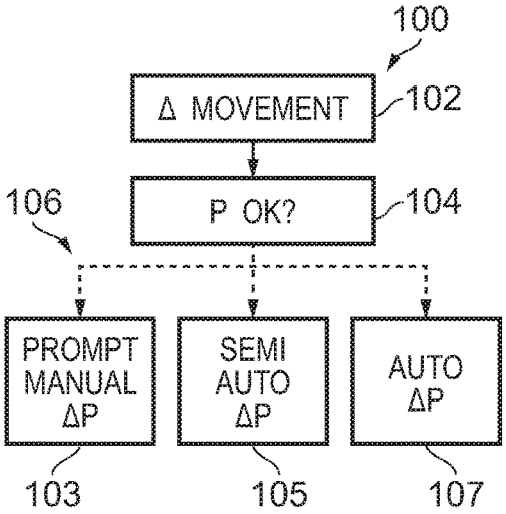
FIG. 6 illustrates an example of the method illustrated in FIG. 5 in more detail.

FIG. 6 illustrates an example of the method 100 illustrated in FIG. 5 in more detail. In this example, the method at block 106 comprises, in dependence upon determining that a current filter parameter p for the one or more sound sources 80 are to be changed, enabling adaptation of the current filter parameter p for the one or more sound sources 80:

by automatically prompting 103, in the MMI 22 via option 24, manual variation of the filter parameter (set of spatial audio processing parameters P); or by automatically offering 105 for acceptance, in the MMI 22 via option 24, a new filter parameter (new set of spatial audio processing parameters P), for example, by automatically providing the option 24 to a user to select one of the stored multiple sets 42 of predetermined spatial audio processing parameters P for differently moving sound sources 80;

by automatically applying a new filter parameter (new set of spatial audio processing parameters P).

In some examples, the set 42 of predetermined spatial audio processing parameters P (e.g. filter parameter p) used for spatial processing is based on an algorithm in dependence upon the actual or expected change in movement for one or more sound sources 80 rendered as spatial audio. A new filter parameters $p_{new}$ used for spatial audio processing the one or more sound sources 80 may be generated by adapting the current filter parameters $p_{current}$ used for spatial audio processing the one or more sound sources 80 now, in dependence upon the algorithm $p_{new}=\lambda p_{current}$, where $\lambda$ is determined based upon the actual or expected change in movement for the one or more sound sources 80 rendered as spatial audio. For example, if there is less movement the filter window length of an average filter may be lengthened and if there is more movement the filter window length can be shortened. The exact value of $\lambda$ may depend on additional inputs for example $\lambda$ may have a linear or non-linear relationship to a speed of a sound source.

The predetermined spatial audio processing parameters P may be a value of $\lambda$.

Other approaches may be used to determine the sets 42 of predetermined spatial audio processing parameters P used for spatial processing.

Figure 7:
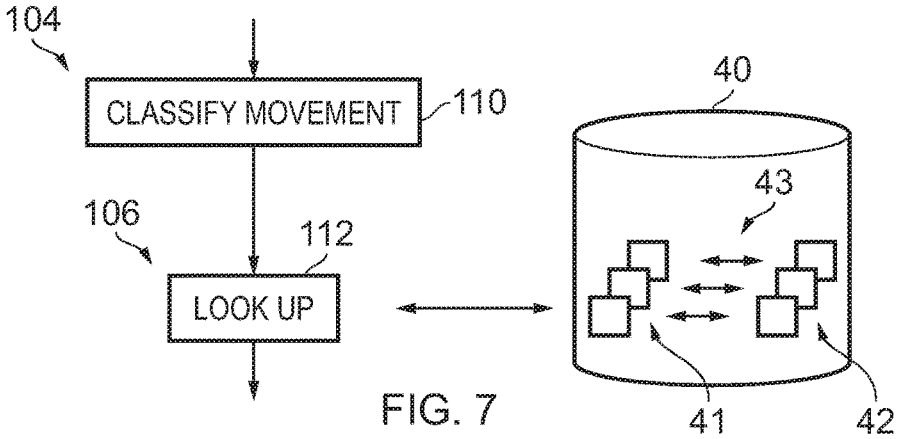
FIG. 7 illustrates an example of a portion of the method illustrated in FIGS. 5 and 6.

FIG. 7 illustrates an example of block 104 and 106 of the method 100.

The database 40 in the non-volatile memory 34 stores sets 42 of predetermined spatial audio processing parameters P in association 43 with different movement classifications 44.

At sub-block 110, of block 104, in dependence upon determining an actual or expected change in movement for one or more sound sources 80 rendered as spatial audio, the method 100 automatically determines a movement classification for the actual or expected change in movement for one or more sound sources 80 rendered as spatial audio. If the movement can be classified, the method moves to the next sub-block.

Then at sub-block 112, the determined movement classification is used to access, in the database 40, the set of predetermined spatial audio processing parameters P associated with the determined movement classification.

The method 100 then proceeds, for example, as illustrated in FIGS. 2, 5 and 6, to automatically provide the option 24 to a user to select the accessed set of predetermined spatial audio processing parameters P for differently moving sound sources 80 and use the selected set of predetermined spatial audio processing parameters P to spatially process audio from one or more sound sources 80.

Figure 8:
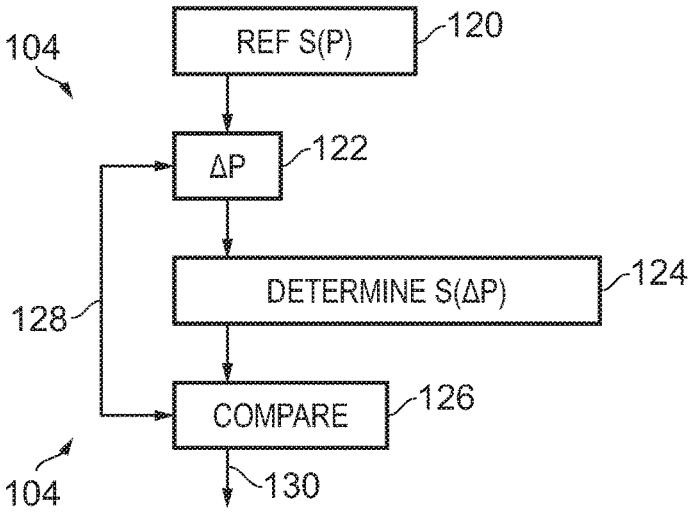
FIG. 8 illustrates an example of a portion of the method illustrated in FIGS. 5 and 6.

FIG. 8 illustrates another example of block 104 and 106 of the method 100.

This figure illustrates an example of a method that enables adaptation of the current filter parameters p for the one or more sound sources 80 by adapting the current filter parameters p for the one or more sound sources 80 based on a search for better filter parameters p for the one or more sound sources 80.

At sub-block 120, a reference value is determined. The current filter parameters p for the one or more sound sources 80 are used to filter expected positions 72 representing an expected movement of the sound source(s).

An error value can be determined by measuring a fit between the filtered expected positions and the unfiltered expected positions. The error value is stored as a reference value. It is a figured of merit for the current filter parameters p.

At sub-block 122 the filter parameters p for the one or more sound sources 80 are varied. The variation may be based upon the expected positions of the one or more sound sources. For example, if the filter parameter is a filter window length, it may be lengthened if the expected positions indicate that the one or more sound sources are slowing down or may be shortened if the expected positions indicate that the one or more sound sources are speeding up.

At sub-block 124 the varied filter parameters $\Delta p$ for the one or more sound sources 80 are used to filter expected positions 72 representing an expected movement of the sound source(s).

An error value can be determined by measuring a fit between the newly filtered expected positions and the unfiltered positions. The error value is stored as a test value. It is a figure of merit for the new filter parameters $\Delta p$.

At sub-block 126 the test value is compared to the reference value. If the difference between the test value and the reference value is less than a threshold, the new filter parameters $\Delta p$ is selected for use.

If the difference between the test value and the reference value is not less than a threshold, the method returns 128 to sub-block 122 and varies the new filter parameters $\Delta p$. The method then proceeds from sub-block 122. In this way, the method searches the filter parameter space for a suitable filter parameter value.

A constraint may be placed as to which portions of the parameter space can and cannot be searched. For example, a filter window length may be forced to be greater than or equal to a minimum value.

The determination of expected positions may, for example, be determined by applying a gain value to the current movement, adding noise, such as white Gaussian distributed noise with a variance dependent upon movement, predicting future movement based on past movement and the expectation that prior patterns of movement will be repeated, or by seeking input from the user via the MMI 22 concerning expected movement e.g. horizontal-left, horizontal-right, dancing, etc.

It will therefore be appreciated from the foregoing that the apparatus 10 therefore comprises:

at least one processor 32; and at least one memory 34 including computer program code the at least one memory 34 and the computer program code configured to, with the at least one processor 32, cause the apparatus 10 at least to perform providing in a man machine interface an option for a user to select one of multiple sets of predetermined spatial audio processing parameters for differently moving sound sources; and in response to the user selecting one of the stored multiple sets of predetermined spatial audio processing parameters for differently moving sound sources, using the selected one of the stored multiple sets of predetermined spatial audio processing parameters to control spatial processing of audio from one or more sound sources.

It will therefore be appreciated from the foregoing that the apparatus 10 therefore comprises:

at least one processor 32; and at least one memory 34 including computer program code the at least one memory 34 and the computer program code configured to, with the at least one processor 32, cause the apparatus 10 at least to perform:

determining an actual or expected change in movement for one or more sound sources rendered as spatial audio; in dependence upon determining an actual or expected change in movement for one or more sound sources rendered as spatial audio, determining that current filter parameters for the one or more sound sources are to be changed; in dependence upon determining that current filter parameters for the one or more sound sources are to be changed, enabling adaptation of the current filter parameters for the one or more sound sources to render the one or more sound sources as spatial audio, compensated for the determined actual or expected change in movement.

Figure 9:
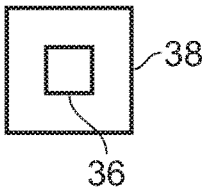
FIG. 9 illustrates an example of a delivery mechanism for a computer program.

As illustrated in FIG. 9, the computer program 36 may arrive at the apparatus 10 via any suitable delivery mechanism 38. The delivery mechanism 38 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 36. The delivery mechanism may be a signal configured to reliably transfer the computer program 36. The apparatus 10 may propagate or transmit the computer program 36 as a computer data signal.

Although the memory 34 is illustrated in FIG. 3 as a single component/circuitry it may be implemented as one or more separate components/circuitry some or all of which may be integrated/removable and/or may provide permanent/semi-permanent/dynamic/cached storage.

Although the processor 32 is illustrated in FIG. 3 as a single component/circuitry it may be implemented as one or more separate components/circuitry some or all of which may be integrated/removable. The processor 32 may be a single core or multi-core processor.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The blocks illustrated in FIGS. 1-8 may represent steps in a method and/or sections of code in the computer program 36. The illustration of a particular order to the blocks does not necessarily imply that there is a required or preferred order for the blocks and the order and arrangement of the block may be varied. Furthermore, it may be possible for some blocks to be omitted.

Where a structural feature has been described, it may be replaced by means for performing one or more of the functions of the structural feature whether that function or those functions are explicitly or implicitly described.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one" or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising at least one processor and at least one memory, the memory comprising machine-readable instructions, that when executed cause the apparatus to:

store in a non-volatile memory multiple sets of predetermined spatial audio processing parameters for differently moving sound sources, wherein the multiple sets comprise a first set of predetermined spatial audio processing parameters for slowly moving sound sources and a second set of predetermined spatial audio processing parameters for quickly moving sound sources;

provide in a man machine interface an option for a user to select one of the stored multiple sets of predetermined spatial audio processing parameters for differently moving sound sources; and in response to the user selecting one of the stored multiple sets of predetermined spatial audio processing parameters for differently moving sound sources, the apparatus is further caused to use the selected one of the stored multiple sets of predetermined spatial audio processing parameters to spatially process audio from one or more sound sources.

2. An apparatus as claimed in claim 1, wherein each set of predetermined spatial audio processing parameters for differently moving sound sources comprises one or more parameters that change relatively.

3. An apparatus as claimed in claim 1, wherein the first set of predetermined spatial audio processing parameters comprise a first filter parameter for a noise reduction filter and the second set of predetermined spatial audio processing parameters comprise a second filter parameter for the noise reduction filter, different to the first filter parameter for the noise reduction filter.

4. An apparatus as claimed in claim 1 further caused to: enable user adaptation of one or more of the spatial audio processing parameters of the selected one of the stored multiple sets of predetermined spatial audio processing parameters to spatially process audio from one or more sound sources without varying the stored sets of predetermined spatial audio processing parameters for differently moving sound sources.

5. An apparatus as claimed in claim 1 further caused to: determine an actual or expected change in movement for one or more sound sources rendered as spatial audio;

in dependence upon determining an actual or expected change in movement for one or more sound sources rendered as spatial audio, the apparatus is caused to automatically determine that current spatial audio processing parameters for the one or more sound sources are to be changed;

in dependence upon determining that current spatial audio processing parameters for the one or more sound sources are to be changed, the apparatus is caused to automatically provide the option to a user to select one of the stored multiple sets of predetermined spatial audio processing parameters for differently moving sound sources.

6. An apparatus as claimed in claim 1 further caused to:

store in the non-volatile memory sets of predetermined spatial audio processing parameters in association with different movement classifications;

in dependence upon determining an actual or expected change in movement for one or more sound sources rendered as spatial audio, the apparatus is caused to automatically determine a movement classification for the actual or expected change in movement for one or more sound sources rendered as spatial audio and using the determined movement classification to access the set of predetermined spatial audio processing parameters associated with the determined movement classification in the non-volatile memory; and automatically provide the option to a user to select the accessed set of predetermined spatial audio processing parameters for differently moving sound sources and use the selected set of predetermined spatial audio processing parameters to spatially process audio from one or more sound sources.

7. An apparatus as claimed in claim 1, wherein each set of predetermined spatial audio processing parameters for differently moving sound sources comprises one or more parameters that change relatively, between sound sources, one or more of: location-based processing, sound intensity, frequency spectrum, reverberation, sound source size.

8. An apparatus comprising at least one processor and at least one memory, the memory comprising machine-readable instructions, that when executed cause the apparatus to:

determine an actual or expected change in movement for one or more sound sources rendered as spatial audio;

in dependence upon determining an actual or expected change in movement for one or more sound sources rendered as spatial audio, the apparatus is caused to determine that a current filter parameter for the one or more sound sources is to be changed; and in dependence upon determining that the current filter parameter for the one or more sound sources is to be changed, the apparatus is caused to enable adaptation of the current filter parameter for the one or more sound sources to render the one or more sound sources as spatial audio, compensated for the determined actual or expected change in movement.

9. An apparatus as claimed in claim 8, wherein enabling adaptation of the current filter parameter comprises:

prompting manual variation of the current filter parameter; or offering for acceptance a filter parameter; or automatically applying a new filter parameter.

10. An apparatus as claimed in claim 8 further caused to, enable a same relative variation of a filter parameter for multiple sound sources to render the multiple sound sources as spatial audio, compensated for change in movement.

11. An apparatus as claimed in claim 10, wherein the multiple sound sources are a sub-set of a set of active sound sources.

12. An apparatus as claimed in claim 8, wherein enabling adaptation of the current filter parameter for the one or more sound sources comprises adapting the current filter parameter for the one or more sound sources based on an algorithm in dependence upon the actual or expected change in movement for one or more sound sources rendered as spatial audio.

13. A method comprising:

storing in a non-volatile memory multiple sets of predetermined spatial audio processing parameters for differently moving sound sources, wherein the multiple sets comprise a first set of predetermined spatial audio processing parameters for slowly moving sound sources and a second set of predetermined spatial audio processing parameters for quickly moving sound sources;

providing in a man machine interface an option for a user to select one of the stored multiple sets of predetermined spatial audio processing parameters for differently moving sound sources; and in response to the user selecting one of the stored multiple sets of predetermined spatial audio processing parameters for differently moving sound sources, using the selected one of the stored multiple sets of predetermined spatial audio processing parameters to spatially process audio from one or more sound sources.

14. A method as claimed in claim 13, wherein each set of predetermined spatial audio processing parameters for differently moving sound sources comprises one or more parameters that change relatively.

15. A method as claimed in claim 13, comprising: enabling user adaptation of one or more of the spatial audio processing parameters of the selected one of the stored multiple sets of predetermined spatial audio processing parameters to spatially process audio from one or more sound sources without varying the stored sets of predetermined spatial audio processing parameters for differently moving sound sources.

16. A method as claimed in claim 13, comprising: determining an actual or expected change in movement for one or more sound sources rendered as spatial audio;

in dependence upon determining an actual or expected change in movement for one or more sound sources rendered as spatial audio, automatically determining that current spatial audio processing parameters for the one or more sound sources are to be changed;

in dependence upon determining that current spatial audio processing parameters for the one or more sound sources are to be changed, automatically providing the option to a user to select one of the stored multiple sets of predetermined spatial audio processing parameters for differently moving sound sources.

17. A method as claimed in claim 13, comprising:

storing in the non-volatile memory sets of predetermined spatial audio processing parameters in association with different movement classifications;

in dependence upon determining an actual or expected change in movement for one or more sound sources rendered as spatial audio, automatically determining a movement classification for the actual or expected change in movement for one or more sound sources rendered as spatial audio and using the determined movement classification to access the set of predetermined spatial audio processing parameters associated with the determined movement classification in the non-volatile memory; and automatically providing the option to a user to select the accessed set of predetermined spatial audio processing parameters for differently moving sound sources and use the selected set of predetermined spatial audio processing parameters to spatially process audio from one or more sound sources.

18. A method as claimed in claim 13, wherein each set of predetermined spatial audio processing parameters for differently moving sound sources comprises one or more parameters that change relatively, between sound sources, one or more of: location-based processing, sound intensity, frequency spectrum, reverberation, sound source size.

19. An apparatus as claimed in claim 1, wherein the slowly moving sound sources are moving more slowly than the quickly moving sound sources.

20. A method as claimed in claim 13, wherein the slowly moving sound sources are moving more slowly than the quickly moving sound sources.

* * * * *